US010246831B1

(12) United States Patent
Loughran

(10) Patent No.: US 10,246,831 B1
(45) Date of Patent: Apr. 2, 2019

(54) SYNTHETIC ICE PANEL

(71) Applicant: James Loughran, Island Park, NY (US)

(72) Inventor: James Loughran, Island Park, NY (US)

( * ) Notice: Subject to any disclaimer, the term of this patent is extended or adjusted under 35 U.S.C. 154(b) by 0 days.

(21) Appl. No.: 15/621,794

(22) Filed: Jun. 13, 2017

Related U.S. Application Data

(60) Provisional application No. 62/349,579, filed on Jun. 13, 2016.

(51) Int. Cl.

| | |
|---|---|
| ***A63C 19/10*** | (2006.01) |
| ***E01C 13/10*** | (2006.01) |
| ***E01C 13/04*** | (2006.01) |
| *E01C 13/00* | (2006.01) |
| *E01C 5/20* | (2006.01) |

(52) U.S. Cl.
CPC ..... *E01C 13/107* (2013.01); *E01C 13/045* (2013.01); *A63C 19/10* (2013.01); *E01C 5/20* (2013.01); *E01C 13/10* (2013.01); *E04F 2201/035* (2013.01)

(58) Field of Classification Search
CPC ..... A63C 19/00; A63C 19/10; A63C 5/00; A63C 5/04; A63B 21/4037; E01C 13/00; E01C 13/02; E01C 13/045; E01C 13/12
USPC ..... 472/88–90; 482/70–71
See application file for complete search history.

(56) References Cited

U.S. PATENT DOCUMENTS

| | | | | |
|---|---|---|---|---|
| 2,257,219 | A | 7/1940 | Bath | |
| 3,379,031 | A | 4/1968 | Lewis, Jr. | |
| 3,508,945 | A * | 4/1970 | Haemer | E01C 13/107 264/49 |
| 3,771,891 | A | 11/1973 | Nirenski et al. | |
| 4,038,834 | A * | 8/1977 | Roberts | A63C 19/10 472/90 |
| 4,169,688 | A * | 10/1979 | Toshio | E01C 5/005 404/40 |
| 4,577,448 | A | 3/1986 | Howorth | |
| 4,703,597 | A * | 11/1987 | Eggemar | A63C 19/10 165/168 |
| 5,497,826 | A * | 3/1996 | Ingram | F24D 13/022 165/56 |
| 6,021,646 | A * | 2/2000 | Burley | A63C 19/10 165/45 |

(Continued)

*Primary Examiner* — Kien Nguyen
(74) *Attorney, Agent, or Firm* — Quickpatents, LLC; Kevin Prince

(57) ABSTRACT

A synthetic ice panel system for use on a ground surface includes plurality of substantially flat panels that mutually interlock to form a rink, such as for ice skating. Each panel includes a top surface, a bottom surface adapted for resting on the ground surface, and a peripheral edge. The peripheral edge includes a plurality of interlocking tabs and recesses operative to mutually interlock with adjacent panels. Each panel is preferably made with a high-density polymer infused with a lubricant. As such, ice skates and the like are able to slide with relatively low friction on the top surface of the panel. Weather permitting; the panels may be inverted in some embodiments wherein the bottom surface of each panel includes a cooling channel containing a cooling tube through which a coolant flows to freeze water resting on the panel, thereby forming a layer of ice above the panel.

19 Claims, 6 Drawing Sheets

(56) References Cited

U.S. PATENT DOCUMENTS 6,139,438 A 10/2000 Park et al.
7,347,788 B2 * 3/2008 Smith, II ..... A63B 69/0022
472/88

* cited by examiner

SYNTHETIC ICE PANEL

CROSS-REFERENCE TO RELATED APPLICATIONS

This application claims the benefit of U.S. Provisional Patent Application 62/349,579, filed on Jun. 13, 2017, and incorporated herein by reference.

STATEMENT REGARDING FEDERALLY SPONSORED RESEARCH AND DEVELOPMENT

Not Applicable.

FIELD OF THE INVENTION

This invention relates to ice skating, and more particularly to a synthetic ice rink panel.

DISCUSSION OF RELATED ART

Artificial skating rink floor panel systems are known in the art. Many such systems include cooling pipes for freezing water on a top surface thereof. However, in warmer environments or seasons, forming ice on the top surface of such a floor can be either impossible or impractical.

Further, artificial skating rink floor panel systems of the prior art have a relatively high friction with ice skates when compared with flat ice, and as such non-ice floor panels of the prior art are not as desirable to use.

Therefore, there is a need for an artificial system that provides for both natural ice formation on one side of the panel, and provides for an effective artificial ice surface on the other side of the panel when ice formation is not possible or practical. S a needed artificial ice panel would be lightweight, relatively easy to transport, and easy to assemble. The present invention accomplishes these objectives.

SUMMARY OF THE INVENTION

The present device is a synthetic ice panel system for use on a ground surface, such as a cement slab, tile floor, or the like. A plurality of substantially flat panels mutually interlock to form a rink, such as for ice skating. Each panel includes a top surface, a bottom surface adapted for resting on the ground surface, and a peripheral edge. The peripheral edge includes a plurality of interlocking tabs and recesses operative to mutually interlock with adjacent panels.

Each panel is preferably made with a high-density polymer, such as Ultra High Molecular Weight Polyethylene (UHMWPE), or the like, infused with a lubricant, such as a silicon lubricant. As such, ice skates and the like are able to slide with relatively low friction on the top surface of the panel.

In some embodiments, a finished edge piece having the tabs and recesses along one edge but a smooth opposing edge may be included for providing a finished edge to the rink. Such finished edge pieces may also include a corner piece having a degree finished edge, for example.

In some embodiments, when environmental conditions permit practical freezing of water on the panels, the panels may all be inverted so that the top surface is resting on the ground and the bottom surface is facing upward. A plurality of cooling channels are formed into the bottom surface of each panel, and each cooling channel includes a cooling tube into which a cooling agent such as brine water is introduced to freeze water and/or a sand/water mixture resting on the bottom surface of the panel. As such, a layer of seamless ice forms above the plurality of panels. If the environment warms to an extent where it is impractical or impossible to freeze any water on the bottom surface of the panels, the cooling tubes may be removed from the channels, or not, and the panels flipped so that the top surface is again facing upward and ready for use as an artificial ice surface for skating and the like.

The present invention is an artificial ice system that provides for both natural ice formation on one side of the panel, and provides for an effective artificial ice surface on the other side of the panel when ice formation is not possible or practical. The panels of the present invention are lightweight, relatively easy to transport, and easy to assemble together to form a skating rink. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
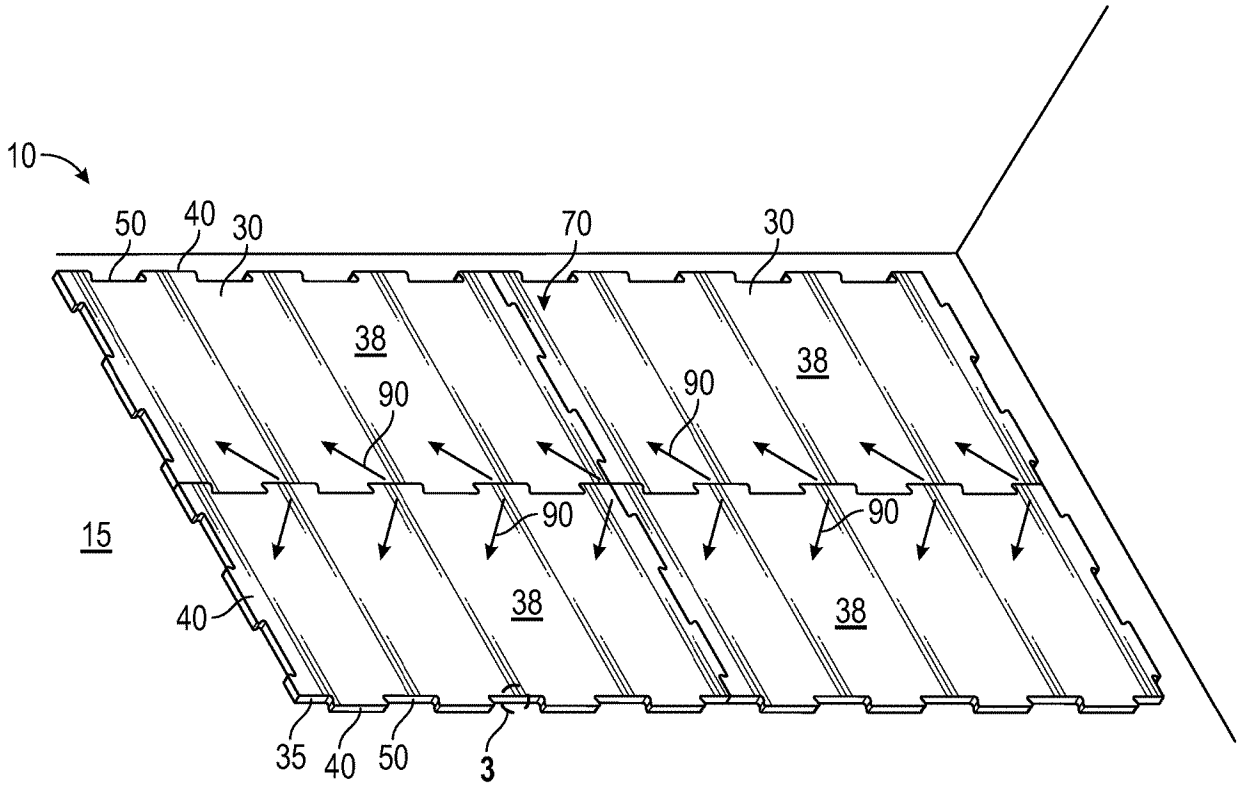
FIG. 1 is a perspective view of a plurality of artificial ice panels of the present invention as assembled.
Figure 2:
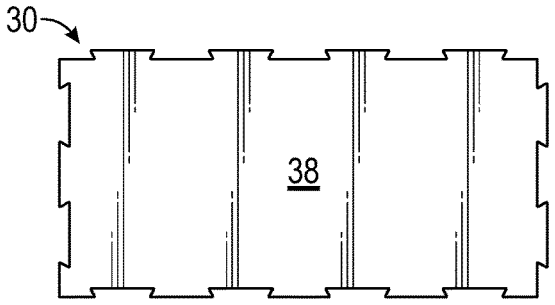
FIG. 2 is a top plan view of a first embodiment of one of the artificial ice panels, having an aspect ratio of 2:1.
Figure 3:
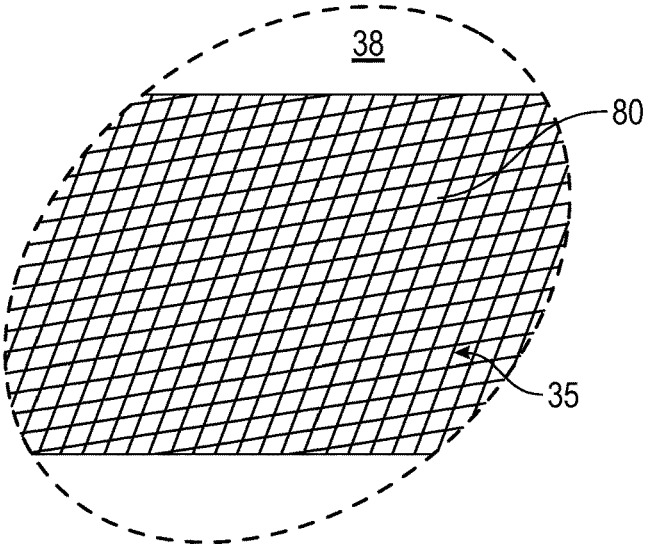
FIG. 3 is an enlarged partial view of a recess in a peripheral edge of one of the panels, illustrating a high-friction knurled edge.

FIGS. 1 and 2 illustrate a synthetic ice panel system 10 for use on a ground surface 15, such as a cement slab, tile floor, or the like. Preferably the ground surface 15 is flat and free of bumps, divots, crevices or the like.

A plurality of substantially flat panels 30 mutually interlock to form a rink 70, such as for ice skating. Each panel 30 includes a top surface 38, a bottom surface 32 adapted for resting on the ground surface 15, and a peripheral edge 35. The peripheral edge 35 includes a plurality of interlocking tabs 40 and recesses 50 operative to mutually interlock with adjacent panels 30 (FIG. 1). Preferably each interlocking tab 40 and/or recess 50 includes a knurled surface 80 to increase the friction fit of the tabs 40 into the recess 50, thereby inhibiting disengagement thereof.

Each panel 30 is preferably made with a high-density polymer, such as Ultra High Molecular Weight Polyethylene (UHMWPE), or the like, infused with a lubricant, such as a silicon lubricant. As such, ice skates (not shown) and the like are able to slide with relatively low friction on the top surface 38 of the panel 30, the lubricant providing for low friction contact between the ice skates and the panel 30.

In some embodiments, when environmental conditions permit practical freezing of water on the panels 30, the panels 30 may all be inverted so that the top surface 38 is resting on the ground 15 and the bottom surface 32 is facing upward. A plurality of cooling channels 120 are formed into the bottom surface 32 of each panel 38, and each cooling channel 120 includes a cooling tube 130 into which a cooling agent (not shown), such as brine water or the like, is introduced to freeze water resting on the bottom surface 32 of the panel 30. As such, a layer of seamless ice forms above the plurality of panels 30. If the environment warms to an extent where it is impractical or impossible to freeze any water on the bottom surface 32 of the panels 30, the cooling tubes 130 may be removed from the channels 120, or not, and the panels flipped so that the top surface 38 is again facing upward and ready for use as an artificial ice surface for skating and the like.

Preferably at least one of the panels 30 includes instructional indicia 90, such as arrows (FIG. 1), formed into the top surface 38 thereof. The instructional indicia 90 may also include textual instructions (not shown), or other symbols (not shown) to aid in the teaching or instruction of a person skating on the panel system 10.

Figure 4:
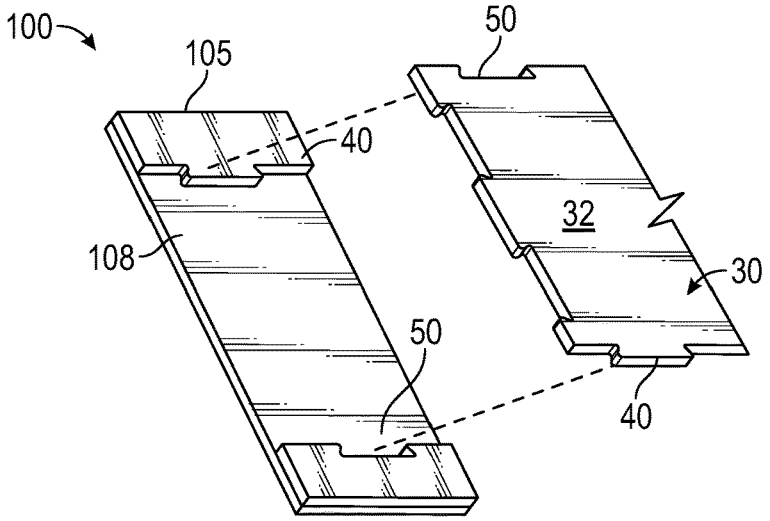
FIG. 4 is an exploded bottom perspective view of an exercise attachment of the invention.

In one embodiment, the panel system 10 further includes an exercise attachment assembly 100 (FIG. 4) having two side engagement members 105 and an elongated foot stop member 108. The side engagement members 105 each are adapted to interlock with a recess 50 or tab 40 of one of the panels 30 and support the elongated foot stop member 108 above the panel 30. As such, an individual's foot with or without an ice skate (not shown) may be fixed between the panel 30 and the foot stop member 108 to hold the foot and/or skate in place while a person performs exercises. The exercise attachment assembly 100 may also be used in tandem with a second exercise attachment assembly 100 (not shown) to be used as a foot stop to perform a lateral side-to-side slide board exercise.

Figure 13:
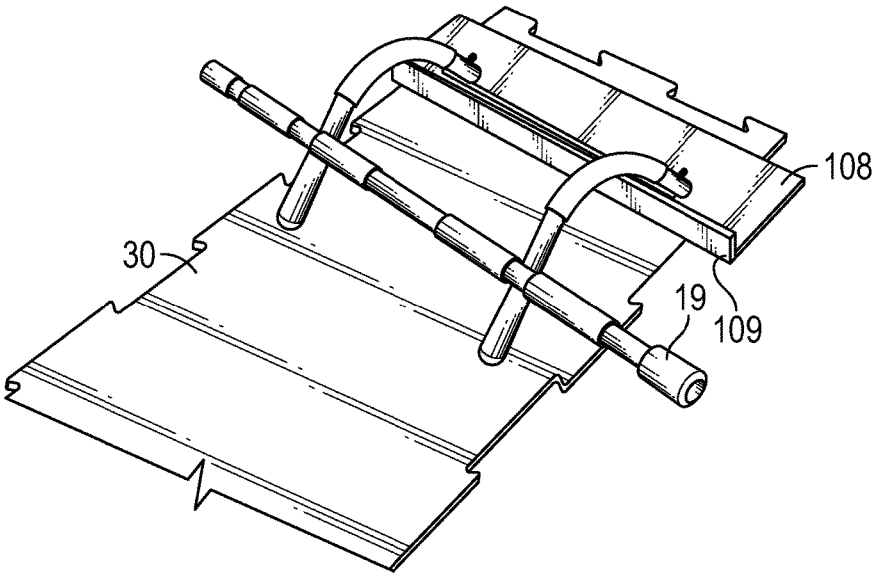
FIG. 13 is a partial perspective view of an alternate embodiment of the exercise attachment.
Figure 14:
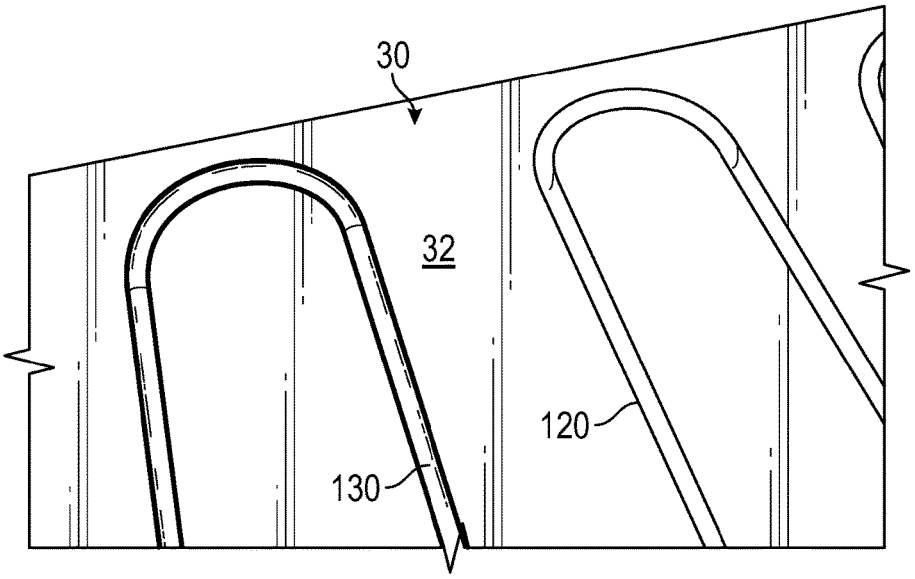
FIG. 14 is an enlarged, partial perspective view of a bottom surface of a panel having the cooling channels and cooling tubes.

In an alternate embodiment of the exercise attachment assembly 100 illustrated in FIG. 13, the elongated foot stop member 108 is not elevated above the panel 30 and instead lies flush against the top surface 38 of the panel 30 and includes a retaining lip 109. As such, an exercise bar device 19 may be used as a handle to manually grasp while performing sliding exercises on the panel 30 with the feet or knees. Typically a low-friction pad or towel (not shown) be used between the feet and/or knees to allow sliding thereof along the panel 30 while the person holds onto the exercise bar device 19, which remains stationary with respect to the panel 30 and the exercise attachment assembly 100.

Figure 5:
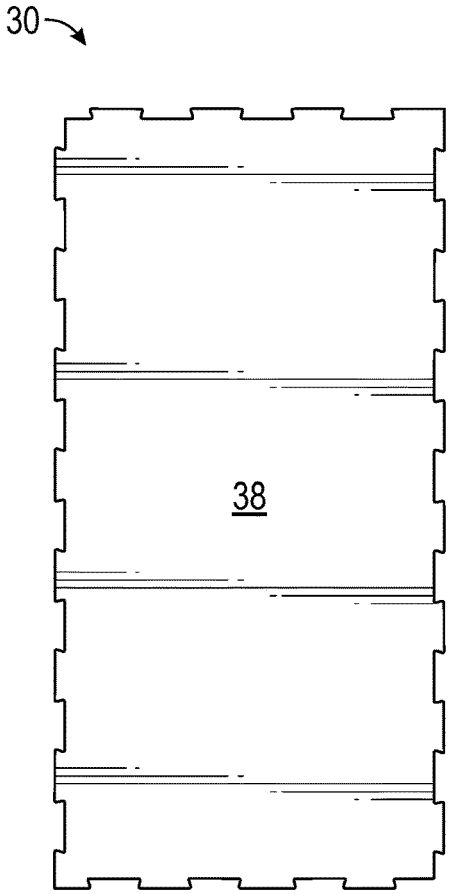
FIG. 5 is a top plan view of another embodiment of one of the artificial ice panels, having an aspect ratio of 2:1.
Figure 6:
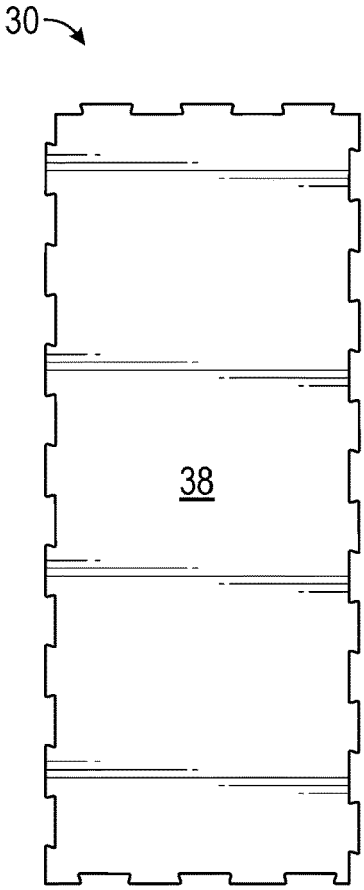
FIG. 6 is a top plan view of another embodiment of one of the artificial ice panels, having an aspect ratio of 5:2.
Figure 7:
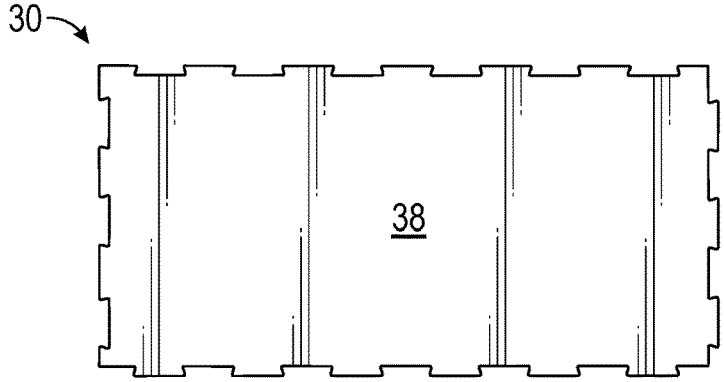
FIG. 7 is a top plan view of another embodiment of one of the artificial ice panels, having an aspect ratio of 2:1.
Figure 8:
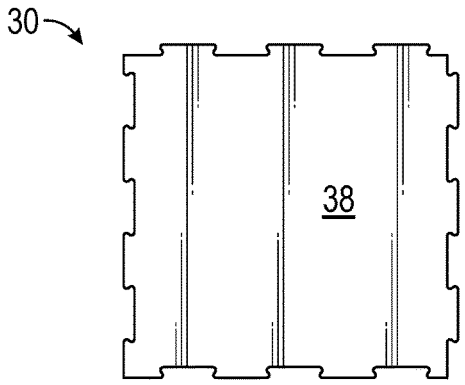
FIG. 8 is a top plan view of another embodiment of one of the artificial ice panels, having an aspect ratio of 1:1.
Figure 9:
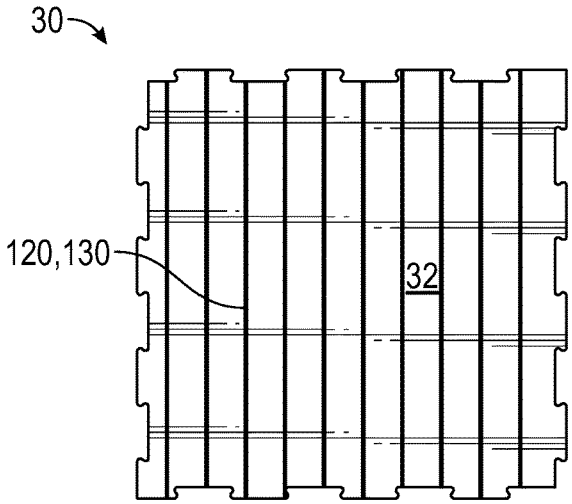
FIG. 9 is a bottom plan view of another embodiment of one of the artificial ice panels, having an aspect ratio of 1:1 and illustrating one embodiment of cooling channels and cooling tubes for freezing water thereon.
Figure 10:
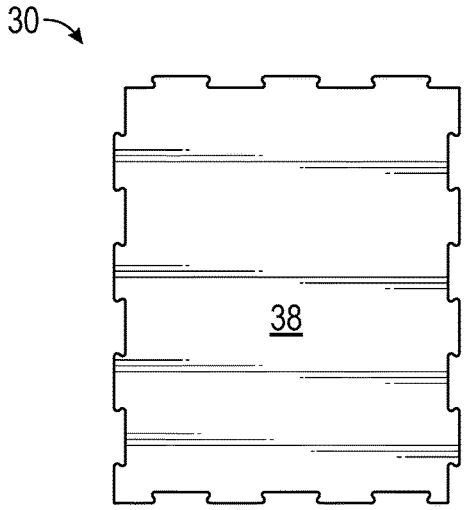
FIG. 10 is a top plan view of another embodiment of one of the artificial ice panels, having an aspect ratio of 5:4.
Figure 11:
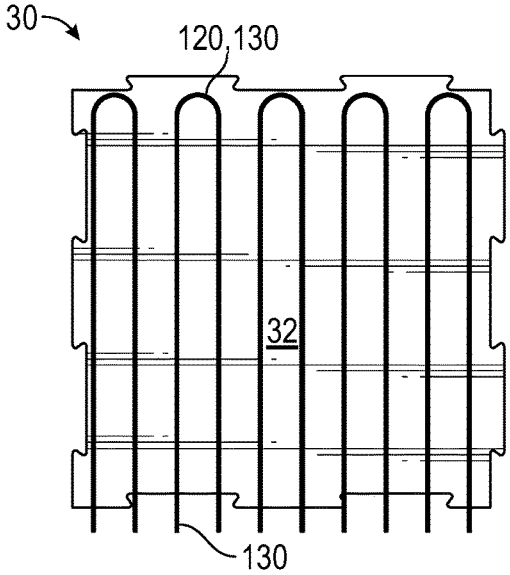
FIG. 11 is a bottom plan view of an embodiment of the invention having the cooling channels and cooling tubes.
Figure 12:
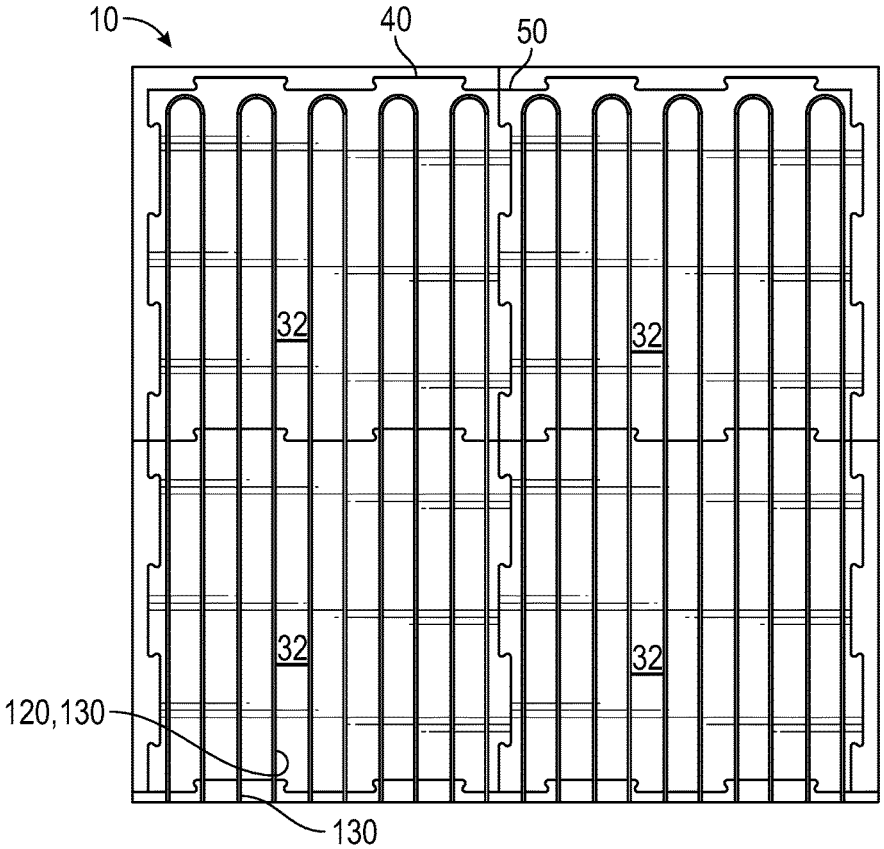
FIG. 12 is a bottom plan view of four of the panels with the cooling channels and cooling tubes.

Preferably the panels 30 are made in sizes suitable for building the rink 70 quickly, such as (in feet) 2×4 (FIG. 2), 4×4 (FIG. 8), 5×10 (FIG. 5), 4×10 (FIG. 6), 4×8 (FIG. 6), 5×5 (FIG. 9), 4×5 (FIG. 10), or other suitable sizes or aspect ratios. Preferably each panel 30 is between 0.25 inches and 0.5 inches thick, or up to one inch thick with embodiments having the cooling channels 120 and cooling tubes 130. In some embodiments, a finished edge piece (not shown) having the tabs 40 and recesses 50 along one edge but a smooth opposing edge may be included for providing a finished edge to the rink 70. Such finished edge pieces may also include a corner piece having a 90-degree finished edge, for example.

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A synthetic ice panel system for use on a ground surface, comprising:

a plurality of substantially flat panels, each panel having a top surface, a bottom surface, and a peripheral edge having a plurality of interlocking tabs and recesses formed uniformly about an outer peripheral interlocking perimeter thereof, the plurality of interlocking tabs and recesses operative to mutually interlock with adjacent such panels, the bottom surface adapted for resting on the ground surface, each panel infused with a lubricant; and an exercise attachment assembly having two side engagement members and an elongated foot stop member, the side engagement members each adapted to interlock with a recess or tab of one of the panels and support the elongated foot stop member above the panel, whereby a foot or ice skate is operable to be fixed between the panel and the foot stop to hold the foot/ice skate in place while a person performs exercises;

whereby when the plurality of panels are supported on the ground surface and mutually interlocked, the panels can be used as a rink for ice skating.

2. The system of claim 1 wherein each panel is made with an Ultra High Molecular Weight Polyethylene (UHMWPE) sheet material infused with the lubricant.

3. The system of claim 2 wherein the lubricant is a silicone-based lubricant.

4. The system of claim 1 wherein the lubricant is a silicone-based lubricant.

5. The system of claim 1 wherein at least a portion of each interlocking tab or recess has a knurled surface, thereby increasing the friction fit of the tabs into the recesses and inhibiting the disengagement thereof.

6. The system of claim 1 further including instructional indicia formed into the top surface of at least one of the panels.

7. The system of claim 6 wherein the instructional indicia include arrows.

8. The system of claim 1 wherein the foot stop is supported between two and three inches above the panel.

9. The system of claim 1 wherein each panel is about two feet wide by four feet long.

10. The system of claim 1 wherein each panel is about four feet wide by four feet long.

11. The system of claim 1 wherein each panel is about five feet wide by ten feet long.

12. The system of claim 1 wherein each panel is about four feet wide by eight feet long.

13. The system of claim 1 wherein each panel is about five feet wide by five feet long.

14. The system of claim 1 wherein each panel is about four feet wide by five feet long.

15. The system of claim 1 wherein a plurality of cooling channels are formed in the bottom surface of each panel, each cooling channel including a cooling tube into which a cooling agent is introduced to freeze water resting on the bottom surface of the panel when the panel is inverted, whereby a layer of is be formed over the panels.

16. The system of claim 1 wherein a plurality of cooling channels are formed in the bottom surface of each panel, each cooling channel including a cooling tube into which a cooling agent is introduced to freeze water resting on the bottom surface of the panel when the panel is inverted, whereby a layer of is be formed over the panels.

17. A synthetic ice panel system for use on a ground surface, comprising:

a plurality of substantially flat panels, each panel having a top surface, a bottom surface, and a peripheral edge having a plurality of interlocking tabs and recesses operative to mutually interlock with adjacent such panels, the bottom surface adapted for resting on the ground surface, each panel infused with a lubricant; and an exercise attachment assembly having two side engagement members and an elongated foot stop member, the side engagement members each adapted to interlock with a recess or tab of one of the panels and support the elongated foot stop member above the panel, whereby a foot or ice skate is operable to be fixed between the panel and the foot stop to hold the foot/ice skate in place while a person performs exercises, whereby when the plurality of panels are supported on the ground surface and mutually interlocked, the panels can be used as a rink for ice skating.

18. The system of claim 17 wherein each panel is made with an Ultra High Molecular Weight Polyethylene (UHMWPE) sheet material infused with the lubricant.

19. The system of claim 17 wherein at least a portion of each interlocking tab or recess has a knurled surface, thereby increasing the friction fit of the tabs into the recesses and inhibiting the disengagement thereof.

* * * * *